US009622507B2

(12) United States Patent
Nunes de Oliveira et al.

(10) Patent No.: US 9,622,507 B2
(45) Date of Patent: Apr. 18, 2017

(54) PROCESS OF TREATING TOBACCO FOR THE DEVELOPMENT OF DISTINCTIVE ORGANOLEPTIC PROPERTIES, USES THEREOF AND SMOKING ARTICLE

(71) Applicant: SOUZA CRUZ S.A., Rio de Janeiro (BR)

(72) Inventors: Geraldo Henrique Nunes de Oliveira, Rio Grande do Sul (BR); Gilson Rufino Sant'anna, Rio Grande do Sul (BR); Carlos Adriano Costa Urbano, Rio Grande do Sul (BR)

(73) Assignee: Souza Cruz S.A., Rio de Janeiro (BR)

( * ) Notice: Subject to any disclaimer, the term of this patent is extended or adjusted under 35 U.S.C. 154(b) by 31 days.

(21) Appl. No.: 14/429,624

(22) PCT Filed: Oct. 16, 2013

(86) PCT No.: PCT/IB2013/059381

§ 371 (c)(1),
(2) Date: Mar. 19, 2015

(87) PCT Pub. No.: WO2014/060956

PCT Pub. Date: Apr. 24, 2014

(65) Prior Publication Data

US 2015/0272201 A1 Oct. 1, 2015

(30) Foreign Application Priority Data

Oct. 16, 2012 (BR) ..... 10 2012 026521 4

(51) Int. Cl.
*A24B 3/12* (2006.01)
*A24B 13/00* (2006.01)
*A24D 1/00* (2006.01)

(52) U.S. Cl.
CPC ..... *A24B 3/12* (2013.01); *A24B 13/00* (2013.01); *A24D 1/00* (2013.01)

(58) Field of Classification Search
CPC ..... A24B 3/04; A24B 3/08; A24B 3/12
See application file for complete search history.

(56) References Cited

U.S. PATENT DOCUMENTS 3,905,123 A 9/1975 Fowler et al.
4,730,627 A 3/1988 Burcham, Jr. et al.
2008/0029110 A1 2/2008 Dube et al.
2009/0032036 A1* 2/2009 Uematsu ..... A24B 15/24 131/275
2010/0200005 A1* 8/2010 Fallon ..... A24B 3/00 131/112
2010/0300463 A1 12/2010 Chen et al.
2012/0167901 A1* 7/2012 Onno ..... A24B 15/14 131/111

FOREIGN PATENT DOCUMENTS

CN 1189986 A 8/1998
CN 1593267 A 3/2005
CN 101322580 A 12/2008
CN 102631017 A 8/2012
EP 1486130 A1 12/2004
GB 2075373 A 11/1981
GB WO 2009056611 A2 * 5/2009 ..... A24B 13/00

OTHER PUBLICATIONS

Room Temperature Definition, Merriam-Webster, 2015.*
International Search Report and Written Opinion, mailed Mar. 21, 2014 for PCT/IB2013/059381, filed Oct. 16, 2013.
Written Opinion, mailed Nov. 4, 2014 for PCT/IB2013/059381, filed Oct. 16, 2013.
International Preliminary Report on Patentability, mailed Feb. 5, 2015 for PCT/IB2013/059381, filed Oct. 16, 2013.

* cited by examiner

*Primary Examiner* — Michael H Wilson
*Assistant Examiner* — Eric Yaary
(74) *Attorney, Agent, or Firm* — McKee, Voorhees & Sease, PLC

(57) ABSTRACT

The present invention relates to a process of treating tobacco for the development of distinctive organoleptic properties, wherein said process comprises the following steps: (a) inserting the previously moistened tobacco to be treated in a closed vessel; (b) monitoring the treatment environment temperature to keep the temperature of the moistened tobacco substantially uniform; (c) keeping the material under treatment for a period of time sufficient for the development of distinguishing flavor and taste; and (d) removing the treated tobacco with an appropriate moisture content having customized flavor features of the product; wherein the material is gently and continuously revolved during the whole treatment in a way not to fragmentize or otherwise damage the raw material being treated.

12 Claims, No Drawings

PROCESS OF TREATING TOBACCO FOR THE DEVELOPMENT OF DISTINCTIVE ORGANOLEPTIC PROPERTIES, USES THEREOF AND SMOKING ARTICLE

CLAIM FOR PRIORITY

This application is the National Stage of International Application No. PCT/IB2013/059381, filed Oct. 16, 2013, which in turn claims priority to and benefit of Brazilian Patent Application No. BR 10 2012 026521 4, filed Oct. 16, 2012. The entire contents of the aforementioned applications are herein expressly incorporated by reference.

FIELD OF THE INVENTION

The present invention relates to a process of treating tobacco, for the development of distinctive and personalized flavour and taste without the addition of any other ingredients, flavourings, aromatizing etc.

BACKGROUND OF THE INVENTION

Treated and/or mixed tobacco for smoking should provide aroma and flavour to meet consumer's demand and also the requirements of the regulatory agencies, as appropriate. Further, tobacco should provide organoleptic features to the final products, such as cigarettes, cigars, pipe tobacco etc., so as to distinguish products from each other and provide a more natural product without the addition of substances such as flavourings and other additives.

The state of the art teaches processes for modifying tobacco characteristics in order to meet the above mentioned requirements. However, such methods are invariably based on the treatment of tobacco with chemical substances which alter its composition, or on the addition of flavouring agents which confer identifying features to the product.

For example, US 2010/0300463 discloses a method of thermal processing of tobacco material, at about 60° C., comprising mixing tobacco with water and an additive selected from lysine, glycine, histidine, alanine, methionine, glutamic acid, aspartic acid, proline, phenylalanine, valine, arginine, di- and trivalent cations, asparaginase, saccharides, phenolic compounds, reducing agents, compounds with a free thiol group, oxidizing agents, oxidation catalysers, plant extracts and combinations thereof.

Nevertheless, a simple, flexible and efficient tobacco treatment method for developing and personalizing its organoleptic features without the need of adding flavouring agents or other chemical products is not known.

SUMMARY OF THE INVENTION

The invention is embodied in form of a process for the treatment of tobacco for the development of distinguishing organoleptic properties, without the incorporation of additives, said process comprising the steps of: (a) introducing the tobacco to be treated, previously moistened, for example, with the simple addition of water to the raw material, such moistening increasing uniformly the tobacco moisture content to a range of about 15 to about 30%, in a closed vessel; (b) monitoring the temperature of the treatment environment, preferably keeping the material in a uniform temperature as to allow its treatment, said temperature varying in the range of about 23° C. to about 90° C., more preferably in a temperature varying in the range of about 25° C. to about 70° C., even more preferably varying in the range of about 40° C. to about 60° C., and, even more preferably, of approximately 50° C.; (c) keeping the material under treatment for a period of time sufficient for the development of distinguishing flavour and taste, preferably for a time in the range of about 20 to about 80 hours, more preferably in the range of about 25 to about 60 hours, even more preferably in the range of about 30 to about 50 hours, and for about 40 hours; and (d) removing the treated tobacco with a moisture content in the range of about 13% to about 20%, having customized flavour features of the product; wherein the material is gently and continuously revolved throughout the whole treatment in a way not to fragmentise or otherwise damage the raw material being treated. The material is revolved in a rotation range varying from about 2 to 15 rpm, more preferably from about 5-10 rpm.

In another embodiment of the invention, the use of the tobacco material treated according to the process of the invention in tobacco blends is provided.

In a further embodiment a smoking article comprising in its blend a tobacco treated according to the process of the present invention is provided.

DETAILED DESCRIPTION OF THE INVENTION

The inventors of the present invention developed a process of treating tobacco material that substitutes the adding of certain chemical substances and/or compounds, distinguishing the tobacco treated thereby, at the same time improving process yield, allowing the use of tobacco products so far not utilised without the addition of certain substances, such as casing and flavours.

The process of the invention is preferably employed in tobacco material that has gone through some sort of pretreatment, e.g., curing. Any type of tobacco may be treated by the process of the invention, including the flue cured, air cured, sun cured and oriental types.

According to the process of the invention, the raw tobacco is placed in a cylindrical chamber provided with tubes for the distribution of heating medium, selected from the group consisting of steam, water and humid air, the latter having a moisture content preferably in the range of 15% to 35%, further preferably of 17% to 30%. Preferably, but not in a limiting way, the moisturizing means is the simple addition of water. The local temperature in the cylindrical chamber, or treatment cylinder, is monitored continuously in order to ensure optimal conditions of treatment for the period in which the tobacco is being treated, that is, during a period varying from 20-80 hours, more preferably in the range of about 25-60 hours, even more preferably in the range between about 30-50 hours and, more preferably, of approximately 40 hours. The tobacco treated with the process of the invention is used to produce a smoking article selected from cigarettes, cigarillos, cigars, tobacco blend for smoking pipe and blend for RYO ("roll your own") or other products from the tobacco industry.

The process of the invention can be employed in any equipment that ensures uniformity of conditions and light mixing in order to avoid fragmentation of the raw tobacco being treated and to allow the proper homogenization of the treated tobacco. The process of the invention can be employed in the equipment described in the co-pending PCT patent application claiming priority from Brazilian Application No. BR 10 2012 026524.9 filed on 16 Oct. 2012, which is herein incorporated in its entirety by reference. The equipment of the referred co-pending patent application for treatment of bulk material sensitive to mechanical stress may comprise (i) a treatment rotating drum (2), composed by an inlet (3) and an exit (4) of the material to be treated; (ii) a treatment fluid inlet (5); (iii) a treatment fluid excess outlet (7); (v) a drive motor (11) for the rotating drum; (vi) a temperature sensor (12). The equipment may comprise a cylindrical chamber formed by the wall of a rotating drum, having a substantially horizontal geometric axis and being provided with a cylindrical base for the input of tobacco to be treated and, on the opposite cylindrical base, an output for the already treated tobacco, that is, with personalized and appropriate moisture content, flavour and taste for direct use in manufacturing the smoking product or in preparing tobacco product blends. Said equipment may be further provided with a temperature sensor and/or controller for monitoring this condition in the appropriate value for the development of the flavour properties without, however, causing superheating that might lead to problems in other physical and organoleptic properties. The treatment chamber may be also provided with tubes, for example, tubes provided with nozzles and/or holes for passing heated steam, for dispensing moisturizing and heating means, which is being fed into said chamber from a reservoir to the chamber interior by means of a rotating valve or similar feeding device, wherein a condensed steam output is further provided. In another embodiment, the provided tubes allow the circulation of steam in closed circuit for distributing heat. The choice of which alternative to be employed (and the conditions to be used in the process) will depend on the desired organoleptic features of the product. The rotating cylinder may be rotated at a velocity of about 2 to about 30 rpm.

Surprisingly, the process of the present invention allows obtaining a highly uniform tobacco product, with enhanced organoleptic properties, providing the tobacco product with personalized features with no addition of flavouring agents and no use of chemical treatment agent, for example, ammonia. The physical features of the product are also enhanced, thus obtaining a malleable tobacco product, with homogenous properties, with excellent cutting power and stable moisture level.

Furthermore, the process of the present invention ensures a superior yield, in terms of raw material to final product, above 90%, when compared to other thermal treatments, which yield varies around 60%. The yield after the process (use yield in the production of smoking products) is also significantly improved, in that it is achieved a smaller loss in the form of powder generation during the manufacture of cigarettes. Another advantage of the invention is in the substantial reduction in time of treatment, which, in the processes used in the market, varies between 4-7 weeks and still result in a product with low sensory amplitude and unfavourable physical properties such as non-malleability, dryness and low cutting power.

Hereinafter, specific embodiments of the invention are presented. Nevertheless, it should be understood that such examples are provided only for illustrative purposes. The modifications or changes that might be introduced in light of the embodiments herein disclosed shall be suggestive to those skilled in the art and should be included within the essence and reach of this description and scope of the accompanying claims.

EXAMPLES

Table 1 shows a comparison between the parameters of the resulting process of the invention and the process and product resulting from a conventional thermal process.

TABLE 1

Comparison between the process and product of the invention and the conventional process

| | PROCESS | |
|---|---|---|
| PARAMETER | INVENTION | CONVENTIONAL |
| Yield (relation raw material/final product) | 95% | 60% |
| Temperature | 23-90° C. | 35-110° C. |
| Processing time | 20-80 hours | 04-07 weeks |
| Process control (temperature, moisture and time) | 100% under control | Many limitations for control |
| Product's sensory features | large and complex sensory amplitude (chocolaty, dry fruits, nutty notes etc.) higher aroma intensity. | low sensory amplitude and low aroma intensity |
| Physical features | high cutting power, high moisture homogeneity and high malleability | low cutting power, dryness and low malleability |

Although certain embodiments were described, they were presented only in an exemplary way, and have no intention of limiting the scope of the invention. Indeed, the new embodiments described herein can be employed in a variety of other forms; more than that, several omissions, substitutions e changes in the form of the embodiments described herein can be done without departing from the essence of the invention. The claims accompanying this description are considered to cover such forms or modifications in that they can be within the scope and essence of the invention.

The invention claimed is:

1. A process of treating smoking tobacco for the development of distinctive organoleptic properties, said process comprising:

(a) inserting moistened tobacco material to be treated in a closed vessel;

(b) monitoring a treatment environment temperature to keep a temperature of the moistened tobacco material substantially uniform:

(c) treating the moistened tobacco material for a period of time sufficient to develop distinguishing flavor and taste without the addition of flayourants to the tobacco during the treating and at a later time, wherein a residence time of the treating the moistened tobacco material is in a range of from about 20 hours to about 80 hours, the treating including gently and continuously revolving the material throughout the treatment so as not to fragmentize or otherwise damage the moistened tobacco being treated, wherein the material is revolved in a rotation range from about 2 rpm to 15 rpm; and (d) removing the treated tobacco material from the closed vessel, the treated tobacco having an appropriate moisture content and customized flavor features.

2. The process according to claim 1, further comprising producing the moistened tobacco by adding water to raw tobacco material sufficient to achieve substantially uniform moisture in a range of 15% to 30%.

3. The process according to claim 1, wherein keeping the temperature of the moistened tobacco substantially uniform comprises maintaining the temperature of the moistened tobacco to within a range of about 23° C. to about 90° C.

4. The process according to claim 3, wherein said temperature of the moistened tobacco is kept within the range of about 25° C. to 70° C.

5. The process according to claim 4, wherein said temperature of the moistened tobacco is kept within the range of about 40° C. to about 60° C.

6. The process according to claim 5, wherein said temperature of the moistened tobacco is approximately 50° C.

7. Process according to claim 1, wherein said residence time is in the range of from about 25 hours to about 60 hours.

8. The process according to claim 7, wherein said residence time is in the range of from about 30 hours to about 50 hours.

9. The process according to claim 8, wherein said residence time is about 40 hours.

10. The process according to claim 1, wherein, at removal, the treated tobacco has a moisture content in a range from about 13% to about 20%.

11. The process according to claim 1, wherein the material is revolved in a rotation range from around 5 rpm to 10 rpm.

12. The process according to claim 1, wherein no treatment fluid is added besides water or water vapor.

* * * * *